US010185278B2

(12) United States Patent
Ando et al.

(10) Patent No.: US 10,185,278 B2
(45) Date of Patent: Jan. 22, 2019

(54) RELAY CONNECTOR FITTING STRUCTURE, ELECTRONIC APPLIANCE, AND IMAGE FORMING APPARATUS

(71) Applicant: KYOCERA Document Solutions Inc., Osaka (JP)

(72) Inventors: Satoshi Ando, Osaka (JP); Ryo Matsuyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 9 days.

(21) Appl. No.: 15/592,801

(22) Filed: May 11, 2017

(65) Prior Publication Data

US 2017/0336749 A1 Nov. 23, 2017

(30) Foreign Application Priority Data

May 20, 2016 (JP) ..... 2016-101658

(51) Int. Cl.

| | |
|---|---|
| ***G03G 15/00*** | (2006.01) |
| ***H01R 13/629*** | (2006.01) |
| ***G03G 21/16*** | (2006.01) |
| *H01R 13/516* | (2006.01) |

(52) U.S. Cl.

CPC ..... *G03G 15/80* (2013.01); *G03G 21/1619* (2013.01); *G03G 21/1652* (2013.01); *H01R 13/629* (2013.01); *G03G 2215/0132* (2013.01); *H01R 13/516* (2013.01)

(58) Field of Classification Search

CPC ..... G03G 15/80; G03G 21/1619; G03G 21/1652; G03G 2215/0132; H01R 13/516; H01R 13/629

See application file for complete search history.

(56) References Cited

U.S. PATENT DOCUMENTS

| | | | | |
|---|---|---|---|---|
| 4,954,085 | A * | 9/1990 | Inoue | H01R 13/6215 439/206 |
| 6,200,156 | B1 * | 3/2001 | Hiraki | H01C 13/00 338/160 |
| 8,938,179 | B2 * | 1/2015 | Amann | G03G 15/0865 399/111 |
| 9,649,796 | B2 * | 5/2017 | Panis | B29C 45/1671 |
| 2006/0110973 | A1 * | 5/2006 | Moritake | H01R 12/774 439/492 |
| 2008/0176423 | A1 * | 7/2008 | Fujimaki | H01R 13/6658 439/76.1 |

(Continued)

FOREIGN PATENT DOCUMENTS

| | | |
|---|---|---|
| JP | S 58-041741 Y | 9/1983 |
| JP | H 04-12278 U | 1/1992 |

(Continued)

*Primary Examiner* — Francis C Gray

(74) *Attorney, Agent, or Firm* — Stein IP, LLC

(57) ABSTRACT

An relay connector fitting structure has a connector, a relay connector, and a chassis. The relay connector is removably fitted with the connector. The chassis has a fitting surface. The chassis has, formed integrally with it, a first stopper restricting movement of the relay connector in a first direction, a second stopper restricting movement of the relay connector in a second direction, and an opposite surface stopper restricting movement of the relay connector to the side opposite from the fitting surface.

19 Claims, 7 Drawing Sheets

(56) References Cited

U.S. PATENT DOCUMENTS

| | | | | |
|---|---|---|---|---|
| 2010/0283904 | A1* | 11/2010 | Takata | F21V 19/0085<br>348/725 |
| 2013/0343777 | A1* | 12/2013 | Amann | G03G 15/0863<br>399/90 |
| 2014/0106607 | A1* | 4/2014 | Suenaga | H01R 9/2608<br>439/527 |

FOREIGN PATENT DOCUMENTS

| | | | |
|---|---|---|---|
| JP | 2004-311223 | A | 11/2004 |
| JP | 2014-93248 | A | 5/2014 |

* cited by examiner

RELAY CONNECTOR FITTING STRUCTURE, ELECTRONIC APPLIANCE, AND IMAGE FORMING APPARATUS

INCORPORATION BY REFERENCE

This application is based upon and claims the benefit of priority from the corresponding Japanese Patent Application No. 2016-101658 filed on May 20, 2016, the entire contents of which are incorporated herein by reference.

BACKGROUND

The present disclosure relates to a relay connector fitting structure, an electronic appliance, and an image forming apparatus. More particularly, the present disclosure relates to a structure for fitting a relay connector to a chassis having a fitting surface, and to an electronic appliance and an image forming apparatus provided with such a structure.

In electronic appliances such as image forming apparatuses and personal computers, electrical wiring such as between one circuit board and another and between a circuit board and an electronic component is achieved not only by direct connection using cables but also by use of relay connectors which connect together connectors provided at end parts of cables. Such relay connectors are fitted to a structural member such as a chassis by use of screws and hooks.

SUMMARY

According to one aspect of the present disclosure, a relay connector fitting structure includes a connector, a relay connector, and a chassis. The connector is provided at an end part of a cable. The relay connector is removably fitted with a plurality of connectors. The chassis has a fitting surface to which the relay connector is fitted. The relay connector has a facing surface arranged to face the fitting surface, a plurality of side surfaces arranged upright from the end edges of the facing surface, and an opposite surface arranged on the side opposite from the facing surface. The chassis has, formed integrally with it, a first stopper which is arranged to face a first side surface—one of the plurality of side surfaces of the relay connector arranged in a first direction—and which restricts movement of the relay connector in the first direction, a second stopper which is arranged to face a second side surface—one of the plurality of side surfaces of the relay connector arranged in a second direction opposite to the first direction—and which restricts movement of the relay connector in the second direction, and an opposite surface stopper which is arranged to face the opposite surface of the relay connector and which restricts movement of the relay connector to the side opposite from the fitting surface.

Further features and advantages of the present disclosure will become apparent from the description of embodiments given below.

DETAILED DESCRIPTION

Embodiments of the present disclosure will be described below with reference to the accompanying drawings.

First Embodiment

Figure 1:
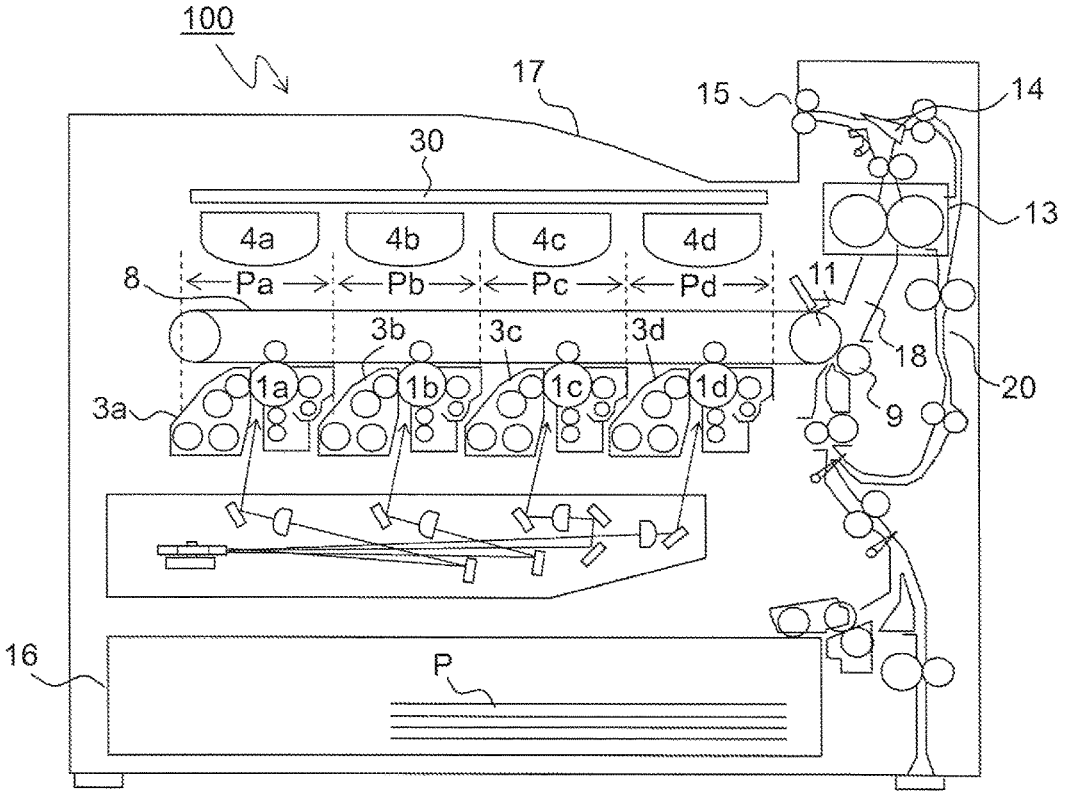
FIG. 1 is a sectional view showing the structure of an image forming apparatus provided with a relay connector fitting structure according to a first embodiment of the present disclosure.

FIG. 1 is a sectional view showing the structure of an image forming apparatus (electronic appliance) 100 provided with a structure for fitting relay connectors 52*a* to 52*d* according to a first embodiment of the present disclosure, and depicts here a tandem-type color image forming apparatus. Inside a main body of the image forming apparatus 100, four image forming sections Pa, Pb, Pc, and Pd are arranged in this order from the upstream side (in FIG. 1, the left side) in the conveying direction. These image forming sections Pa to Pd are provided to correspond to four different colors (cyan, magenta, yellow, and black), and form a cyan, a magenta, a yellow, and a black image successively, each through the processes of electrostatic charging, exposure, development, and transfer.

In the image forming sections Pa to Pd, there are arranged photosensitive drums (image carriers) 1*a*, 1*b*, 1*c*, and 1*d* which carry visible images (toner images) of the different colors, and next to the image forming sections Pa to Pd, there is provided an intermediary transfer belt 8 which rotates counter-clockwise in FIG. 1 by being driven by a driving means (unillustrated).

In the image forming sections Pa to Pd, there are respectively provided photosensitive drums 1*a* to 1*d* which are rotatably arranged, chargers which electrostatically charge the photosensitive drums 1*a* to 1*d*, an exposure device which exposes the photosensitive drums 1*a* to 1*d* to light of image information, developing devices 3*a*, 3*b*, 3*c*, and 3*d* which form toner images on the photosensitive drums 1*a* to 1*d*, and cleaning portions which remove the developer (toner) and the like that are left behind on the photosensitive drums 1*a* to 1*d*.

When image data is fed in from a host device such as a personal computer, electrostatic latent images are formed on the photosensitive drums 1*a* to 1*d* according to the image data. The developing devices 3*a* to 3*d* are charged with predetermined amounts of two-component developer containing toner of different colors, namely cyan, magenta, yellow, and black respectively. When the proportions of toner in the two-component developer contained in the developing devices 3*a* to 3*d* fall below a prescribed value, the developing devices 3*a* to 3*d* are replenished with toner from corresponding toner containers 4*a* to 4*d*. The toner in the developer is fed by the developing devices 3*a* to 3*d* to the corresponding ones of the photosensitive drums 1*a* to 1*d* and electrostatically adheres to them, thereby forming toner images according to the electrostatic latent images formed by exposure to light from the exposure device.

The cyan, magenta, yellow, and black toner images on the photosensitive drums 1*a* to 1*d* are then primarily transferred to the intermediary transfer belt 8. These images of four colors are formed in a predetermined positional relationship that is previously determined for the formation of a predetermined full-color image.

When the intermediary transfer belt 8 starts to rotate counter-clockwise as a driving roller 11 rotates by being driven by a driving motor (unillustrated), a transfer sheet P in a sheet cassette 16 is conveyed, with predetermined timing, to a nip portion (secondary transfer nip portion) between the driving roller 11 and a secondary transfer roller 9 provided next to it, and the full-color image on the intermediary transfer belt 8 is transferred to the transfer sheet P. The transfer sheet P having the toner images transferred to it passes through a sheet conveying passage 18 and is conveyed to a fixing unit 13.

The transfer sheet P conveyed to the fixing unit 13 is heated and pressed by a pair of fixing rollers so that the toner images are fixed to the surface of the transfer sheet P, and thereby the predetermined full-color image is formed on the transfer sheet P. The transfer sheet P having the full-color image formed on it is distributed between different conveying directions by a branch portion 14 which branches into a plurality of directions, so as to be discharged as it is (or after being conveyed to a two-sided conveying passage 20 and having undergone two-sided printing) onto a discharge tray 17 by a pair of discharge rollers 15.

Next, a container lock mechanism 30 including relay connectors 52*a* to 52*d* will be described.

The container lock mechanism 30 is arranged over the toner containers 4*a* to 4*d*, and serves to lock the toner containers 4*a* to 4*d* to prevent them from being detached from the main body of the image forming apparatus 100. Specifically, as shown in FIG. 2, the container lock mechanism 30 includes a chassis 40 made of resin, hook members 31*a* to 31*d* which engage with the toner containers 4*a* to 4*d*, biasing members 32*a* to 32*d* which bias the hook members 31*a* to 31*d* in a predetermined direction, link members 33*a* to 33*d* which engage with the hook members 31*a* to 31*d*, and solenoids 34*a* to 34*d* which engage with the link members 33*a* to 33*d*, respectively.

The hook members 31*a* to 31*d* are formed so as to be swingable about pivots Oa to Od, respectively. The biasing members 32*a* to 32*d* comprise extension coil springs, and bias the hook members 31*a* to 31*d* clockwise in FIG. 2, respectively. This permits the hook members 31*a* to 31*d* to engage with the toner containers 4*a* to 4*d*, respectively, so that, when the solenoids 34*a* to 34*d* are in the off state, the toner containers 4*a* to 4*d* cannot be detached. On the other hand, when the solenoids 34*a* to 34*d* are in the on state, the link members 33*a* to 33*d* are pulled by the solenoids 34*a* to 34*d* to move upward in FIG. 2, respectively, so that, against the biasing forces of the biasing members 32*a* to 32*d*, the hook members 31*a* to 31*d* swing counter-clockwise in FIG. 2, respectively. This permits the hook members 31*a* to 31*d* to unlock the toner containers 4*a* to 4*d*, respectively, and now the toner containers 4*a* to 4*d* can be detached from the main body of the image forming apparatus 100. The solenoids 34*a* to 34*d* can be controlled individually between the on and off states via cables 50*a* to 50*d*, respectively, which will be described below.

The chassis 40 is fitted with cables 50*a* to 50*d* across which the solenoids 34*a* to 34*d* are actuated. Specifically, to the solenoid 34*d*, two cables 50*d* are connected, and the cables 50*d* are hung on a plurality of cable engagement portions 41*a* and 41*b* provided on the chassis 40 to reach the left end of FIG. 2. The cables 50*d* are laid via connectors 51 (see FIG. 3) and the relay connector 52*d* to reach the left end of the chassis 40. A cable 53 that is not electrically connected to any of the solenoids 34*a* to 34*d* is laid from the right end to the left end of the chassis 40, passing by the solenoid 34*d* on the way. The cables 50*d* and the cable 53 take separate paths near the relay connector 52*d*, and then join to take the same path.

Figure 2:
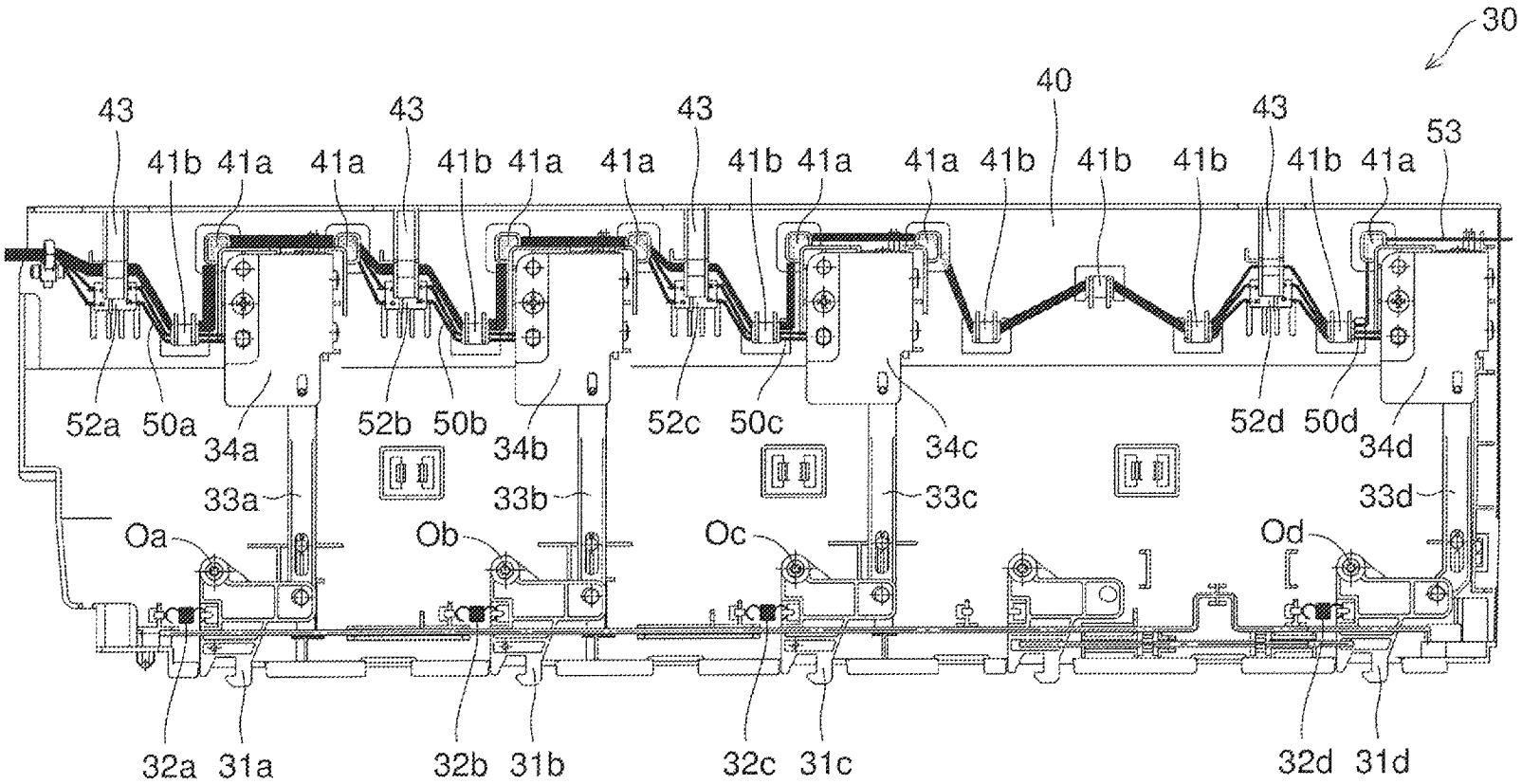
FIG. 2 is a plan view showing the structure of a container lock mechanism including the relay connector fitting structure according to the first embodiment of the present disclosure.

To the solenoid 34*c*, two cables 50*c* are connected, and the cables 50*c* are hung on a plurality of cable engagement portions 41*a* and 41*b* to reach the left end of FIG. 2. The cables 50*c* are laid via connectors 51 and the relay connector 52*c* to reach the left end of the chassis 40. The cables 50*c* and the cables 50*d* and 53 take separate paths near the relay connector 52*c*, and then join to take the same path.

To the solenoid 34*b*, two cables 50*b* are connected, and the cables 50*b* are hung on a plurality of cable engagement portions 41*a* and 41*b* to reach the left end of FIG. 2. The cables 50*b* are laid via connectors 51 and the relay connector 52*b* to reach the left end of the chassis 40. The cables 50*b* and the cables 50*c*, 50*d*, and 53 take separate paths near the relay connector 52*b*, and then join to take the same path.

To the solenoid 34*a*, two cables 50*a* are connected, and the cables 50*a* are hung on a cable engagement portion 41*b* to reach the left end of FIG. 2. The cables 50*a* are laid via connectors 51 and the relay connector 52*a* to reach the left end of the chassis 40. The cables 50*a* and the cables 50*b*, 50*c*, 50*d*, and 53 take separate paths near the relay connector 52*a*, and are bundled together in a left end part of the chassis 40.

Next, the structure around the relay connector 52*d* will be described in detail. While the following description takes up, as an example, the structure around the relay connector 52*d*, the structures around the relay connectors 52*a* to 52*c* are basically the same, and therefore overlapping description will be omitted.

Figure 3:
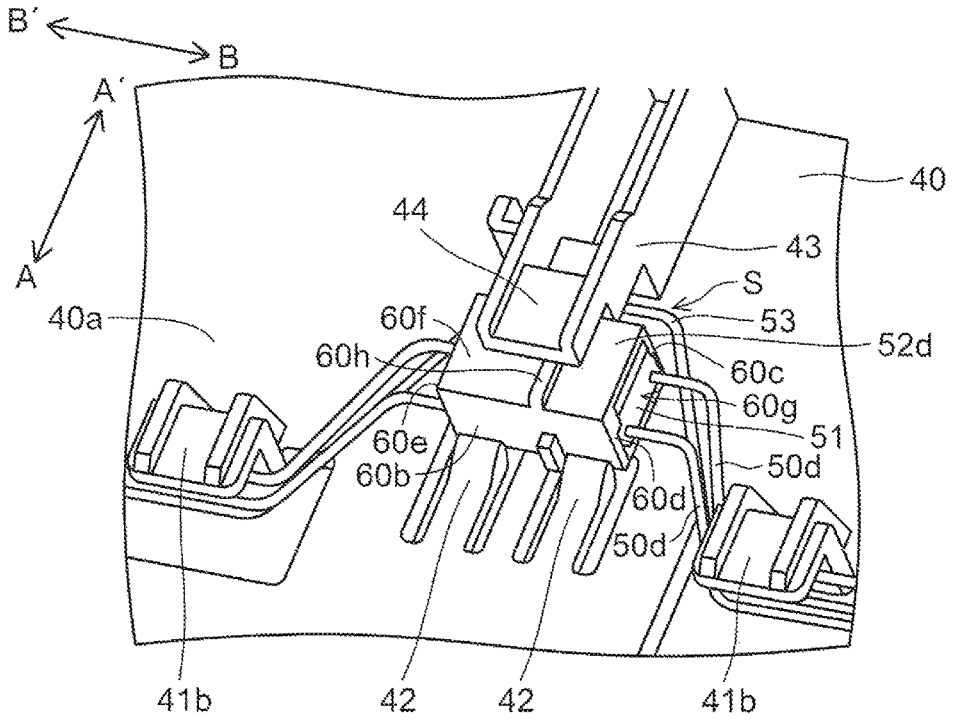
FIG. 3 is a perspective view showing the relay connector fitting structure according to the first embodiment of the present disclosure.
Figure 4:
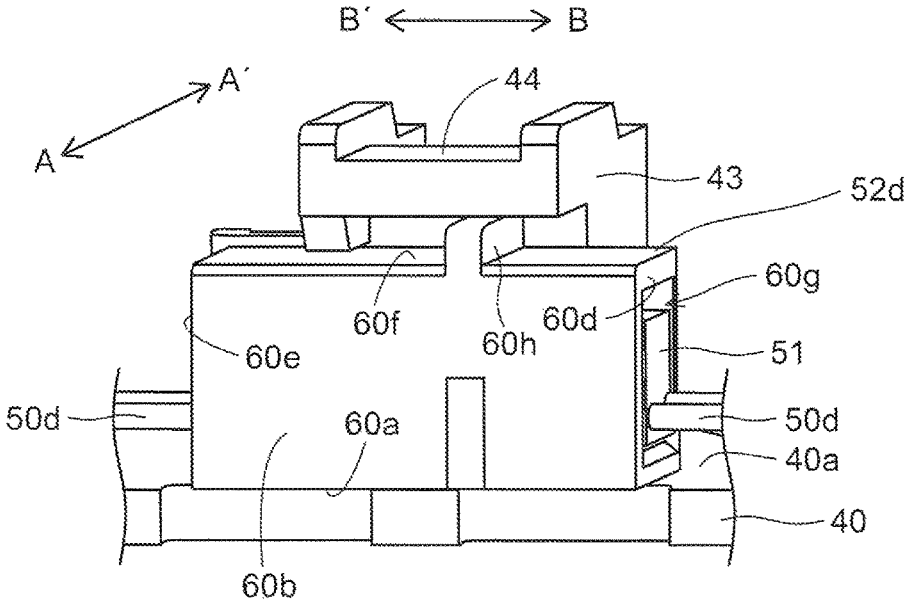
FIG. 4 is a perspective sectional view showing the relay connector fitting structure according to the first embodiment of the present disclosure.

As shown in FIGS. 3 and 4, the relay connector 52*d* has a facing surface 60*a* (bottom surface) arranged to face a fitting surface 40*a* (top surface) of the chassis 40, a plurality of side surfaces (first to fourth side surfaces 60*b* to 60*e*) arranged upright from the end edges of the facing surface 60*a*, and an opposite surface 60*f* (top surface) arranged opposite from the facing surface 60*a*. The plurality of side surfaces include a first side surface 60*b* arranged in the arrow-A direction (first direction), a second side surface 60*c* arranged in the arrow-A' direction (second direction) opposite to the arrow-A direction, a third side surface 60*d* arranged in the arrow-B direction (third direction, the direction perpendicular to the arrows-AA' direction), and a fourth side surface 60*e* arranged in the arrow-B' direction (fourth direction) opposite to the arrow-B direction.

In the third and fourth side surfaces 60*d* and 60*e*, fitting recesses 60*g* are respectively formed in which connectors 51 are fitted. The opposite surface 60*f* has a protrusion 60*h* that protrudes to the side (top side) opposite from the facing surface 60*a*.

The connectors 51 are provided at end parts of the cables 50*d*, and are configured to be removably fitted in the fitting recesses 60*g* of the relay connector 52*d*.

The chassis 40 has, formed integrally with it, two first stoppers 42 which are arranged to face the first side surface 60*b* of the relay connector 52*d* and which restrict movement of the relay connector 52*d* in the arrow-A direction, a second stopper 43 which is arranged to face the second side surface 60*c* and which restricts movement of the relay connector 52*d* in the arrow-A' direction, and an opposite surface stopper 44 which is arranged to face the opposite surface 60*f* and which restricts movement of the relay connector 52*d* to the side (top side) opposite from the fitting surface 40*a*.

Figure 5:
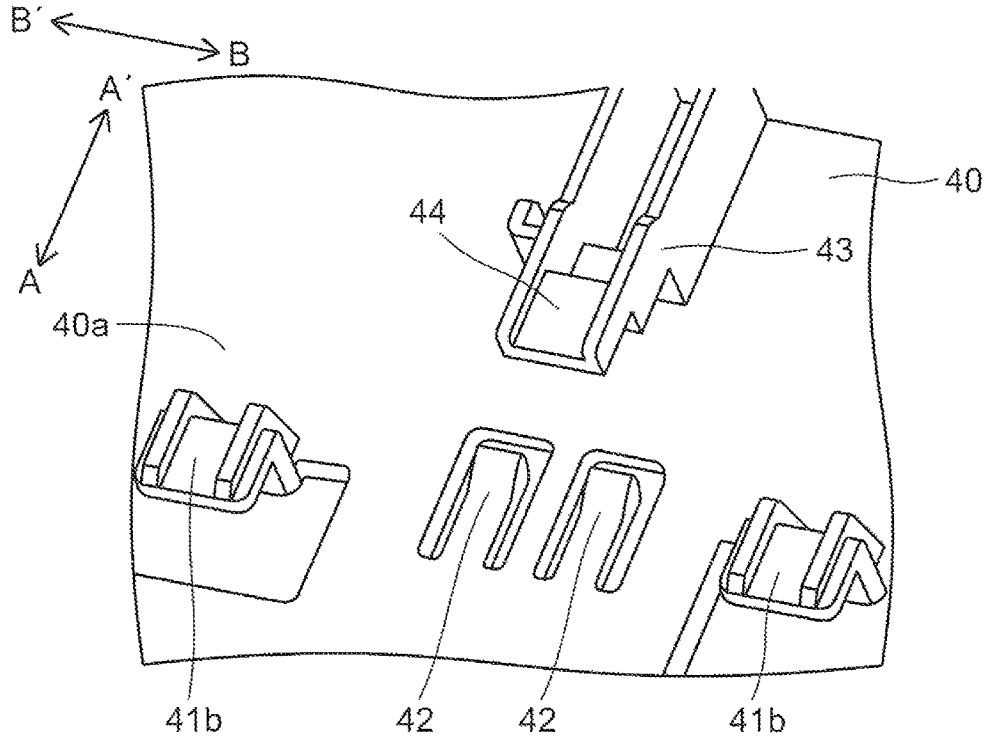
FIG. 5 is a perspective view showing the structure of a chassis to which the relay connector according to the first embodiment of the present disclosure is fitted.

Tip parts of the first stoppers 42 protrude upward from the fitting surface 40*a*. Moreover, as shown in FIG. 5, as a result of a part around the first stopper 42 being cut out, the first stoppers 42 are formed to have a snap-fit structure elastically deformable in the thickness direction of the chassis 40. In the state shown in FIG. 3 (with the relay connector 52*d* fitted to the chassis 40), the first stoppers 42 are arranged with a predetermined gap left from, or in contact with, the first side surface 60*b* of the relay connector 52*d*.

As shown in FIG. 3, the second stopper 43 protrudes upward from the fitting surface 40*a* of the chassis 40, and has an upper part thereof formed to extend toward the second side surface 60*c* of the relay connector 52*d*. Thus, between the second stopper 43 and the second side surface 60*c* of the relay connector 52*d*, a gap S is formed that is passable in the arrows-BB' direction. Through this gap S is laid the cable 53 (non-connector cable), which is not connected to the connectors 51 and the relay connector 52*d*. Moreover, in the state shown in FIG. 3, the second stopper 43 is arranged with a predetermined gap left from, or in contact with, the second side surface 60*c* of the relay connector 52*d*.

The opposite surface stopper 44 is formed to be continuous with a tip part of the second stopper 43. In the state shown in FIG. 4 (with the relay connector 52*d* fitted to the chassis 40), the opposite surface stopper 44 is arranged with a predetermined gap left from, or in contact with, the protrusion 60*h* on the opposite surface 60*f* of the relay connector 52*d*.

Figure 6:
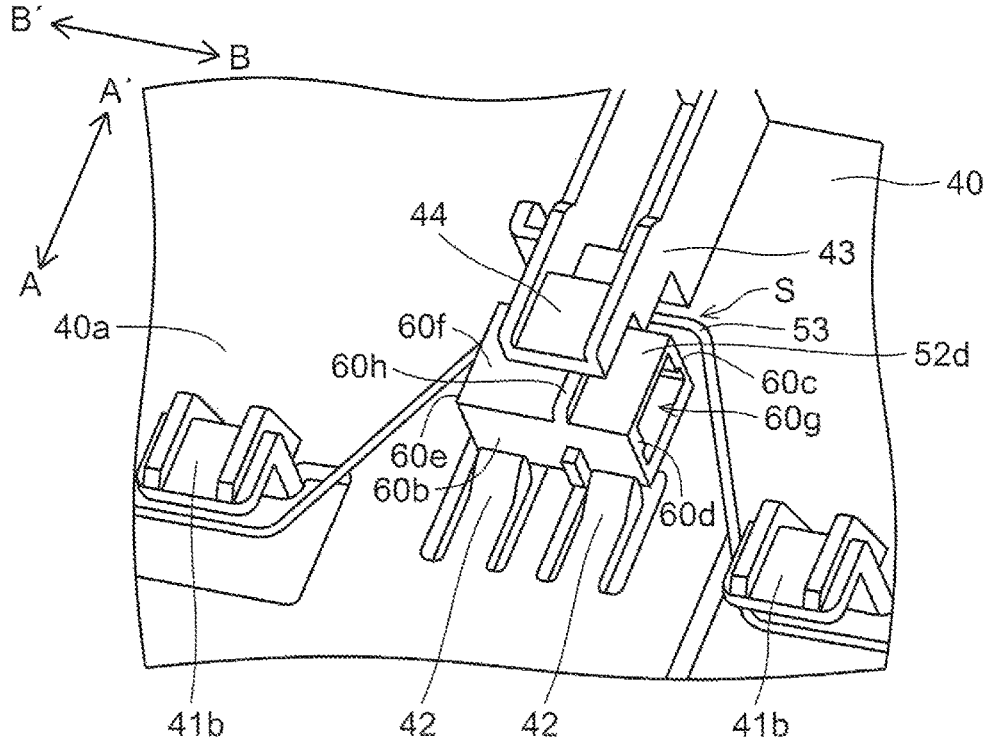
FIG. 6 is a perspective view showing the relay connector according to the first embodiment of the present disclosure fitted to the chassis.

When the relay connector 52*d* is fitted to the chassis 40, first the cable 53 is hung on the cable engagement portions 41*a* and 41*b*, and then the relay connector 52*d* is slid in the arrow-A' direction so as to pass over the first stoppers 42. This causes the first stoppers 42 to elastically deform downward, and when the relay connector 52*d* has run over the first stoppers 42, the first stoppers 42 is restored to the original state as shown in FIG. 6 so as to restrict movement of the relay connector 52*d* in the arrow-A direction. Now the cable 53 remains laid through the gap S between the relay connector 52*d* and the second stopper 43. Thereafter, the connectors 51 are fitted in the fitting recesses 60*g* from the arrow-B and arrow-B' directions, resulting in the state shown in FIG. 3.

In this embodiment, as described above, the chassis 40 has, formed integrally with it, the first stoppers 42 which restrict movement of the relay connectors 52*a* to 52*d* in the arrow-A direction, the second stoppers 43 which restrict movement of the relay connectors 52*a* to 52*d* in the arrow-A' direction, and the opposite surface stoppers 44 which restrict movement of the relay connectors 52*a* to 52*d* to the side opposite from the fitting surface 40*a*. Thus, it is possible, without providing extra fitting members such as screws and hooks, to fit the relay connectors 52*a* to 52*d* to the chassis 40 by use of the first stoppers 42, the second stoppers 43, and the opposite surface stoppers 44 which are formed integrally with the chassis 40. This helps suppress an increase in the number of components, and helps enhance the ease of fitting the relay connectors 52*a* to 52*d* to the chassis 40.

Moreover, as described above, the cable 53 is laid through the gap S between the second stoppers 43 and the relay connectors 52*a* to 52*d*. Thus, the cable 53, which is not connected to the connectors 51, can be fastened with the chassis 40 combined with the relay connectors 52*a* to 52*d*. That is, it is possible, without providing extra members, to fasten the cable 53 to the chassis 40, and this helps further suppress an increase in the number of components.

Moreover, as described above, the first stoppers 42 protrude from the fitting surface 40*a*, and are formed, as a result of parts around the first stoppers 42 being cut out, to be elastically deformable in the thickness direction of the chassis 40. This helps enhance the ease of fitting and removal of the relay connectors 52*a* to 52*d* to and from the chassis 40.

Moreover, as described above, the opposite surface stoppers 44 are formed to be continuous with the second stoppers 43. This helps save space as compared with forming the second stoppers 43 and the opposite surface stoppers 44 separately.

Second Embodiment

Figure 7:
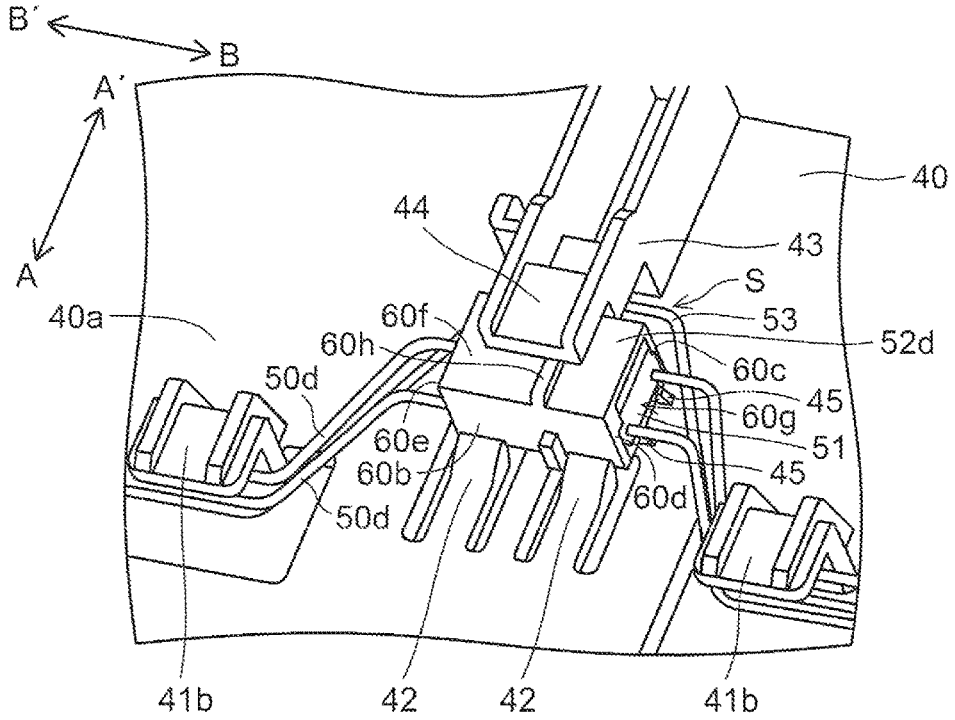
FIG. 7 is a perspective view showing a relay connector fitting structure according to a second embodiment of the present disclosure.
Figure 8:
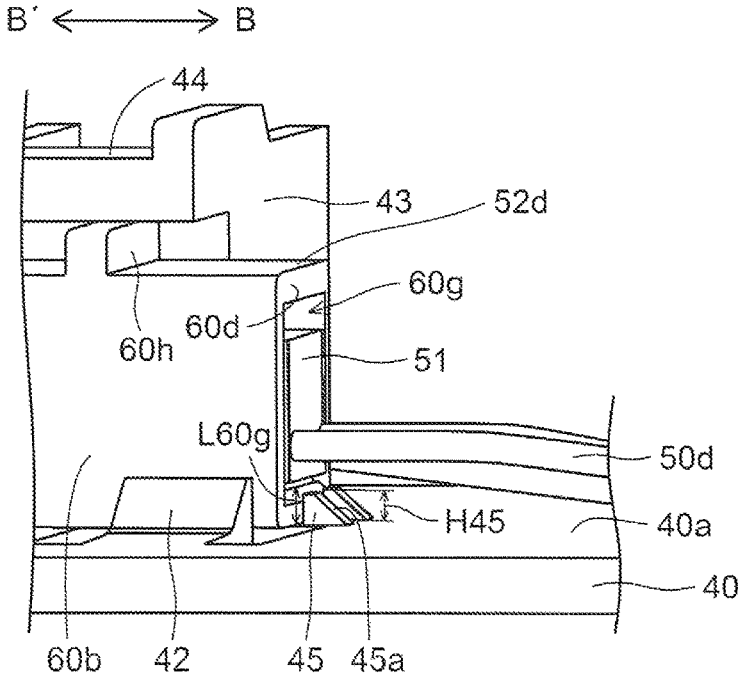
FIG. 8 is a perspective sectional view showing the relay connector fitting structure according to the second embodiment of the present disclosure.
Figure 9:
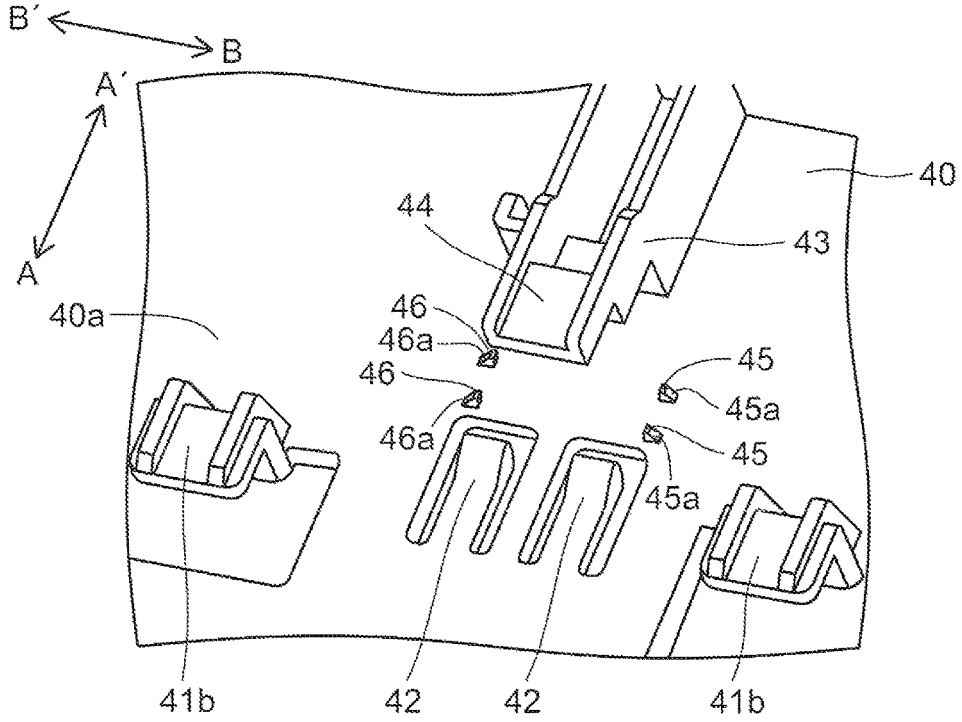
FIG. 9 is a perspective view showing the structure of a chassis to which the relay connector according to the second embodiment of the present disclosure is fitted.

According to a second embodiment of the present disclosure, as shown in FIGS. 7 to 9, the chassis 40 has, integrally formed with it, two third stoppers 45 which are arranged to face the third side surface 60*d* of the relay connector 52*d* and which restrict movement of the relay connector 52*d* in the arrow-B direction and two fourth stoppers 46 which are arranged to face the fourth side surface 60*e* and which restrict movement of the relay connector 52*d* in the arrow-B' direction.

On the third and fourth stoppers 45 and 46, there are respectively formed inclined surfaces 45*a* and 46*b* which guide the connectors 51 into the fitting recesses 60*g*. Moreover, as shown in FIG. 8, the protrusion height H45 of the third stoppers 45 relative to the fitting surface 40*a* is smaller than the distance L60*g* from the fitting surface 40*a* to the fitting recesses 60*g*. The fourth stoppers 46 are formed symmetrically with the third stoppers 45 about the arrows-BB' direction, and the protrusion height (=H45) of the fourth stoppers 46 relative to the fitting surface 40*a* is smaller than the distance L60*g* from the fitting surface 40*a* to the fitting recesses 60*g*.

In other respects in terms of structure, the second embodiment is similar to the first embodiment described previously.

In this embodiment, as described above, the chassis 40 has, integrally formed with it, the third stoppers 45 which restrict movement of the relay connectors 52*a* to 52*d* in the arrow-B direction and the fourth stoppers 46 which restrict movement of the relay connectors 52*a* to 52*d* in the arrow-B' direction. Thus, it is possible also to suppress movement of the relay connectors 52*a* to 52*d* in the arrows-BB' direction relative to the chassis 40.

Moreover, as described above, in a case where the fitting recesses 60*g* are formed in the third and fourth side surfaces 60*d* and 60*e* of the relay connectors 52*a* to 52*d*, when the connectors 51 are fitted to and removed from the relay connectors 52*a* to 52*d*, the relay connectors 52*a* to 52*d* move easily in the arrows-BB' direction; thus, providing the third and fourth stoppers 45 and 46 on the chassis 40 is particularly effective.

Moreover, as described above, on the third and fourth stoppers 45 and 46, there are respectively formed the inclined surfaces 45*a* and 46*b* which guide the connectors 51 into the fitting recesses 60*g*. This helps further enhance the ease of fitting the connectors 51 to the relay connectors 52*a* to 52*d*.

Moreover, as described above, the protrusion height H45 of the third and fourth stoppers 45 and 46 relative to the fitting surface 40*a* is smaller than the distance L60*g* from the fitting surface 40*a* to the fitting recesses 60*g*. This helps suppress a lowering in the ease of fitting and removal of the connectors 51 to and from the relay connectors 52*a* to 52*d*.

In other respects in terms of benefits, the second embodiment is similar to the first embodiment described previously.

Third Embodiment

Figure 10:
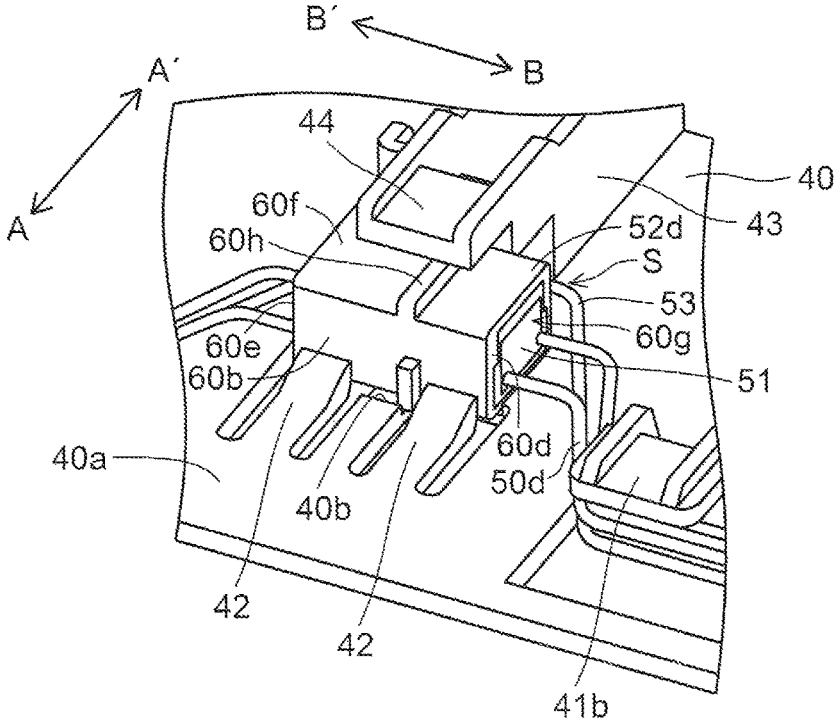
FIG. 10 is a perspective view showing a relay connector fitting structure according to a third embodiment of the present disclosure.
Figure 11:
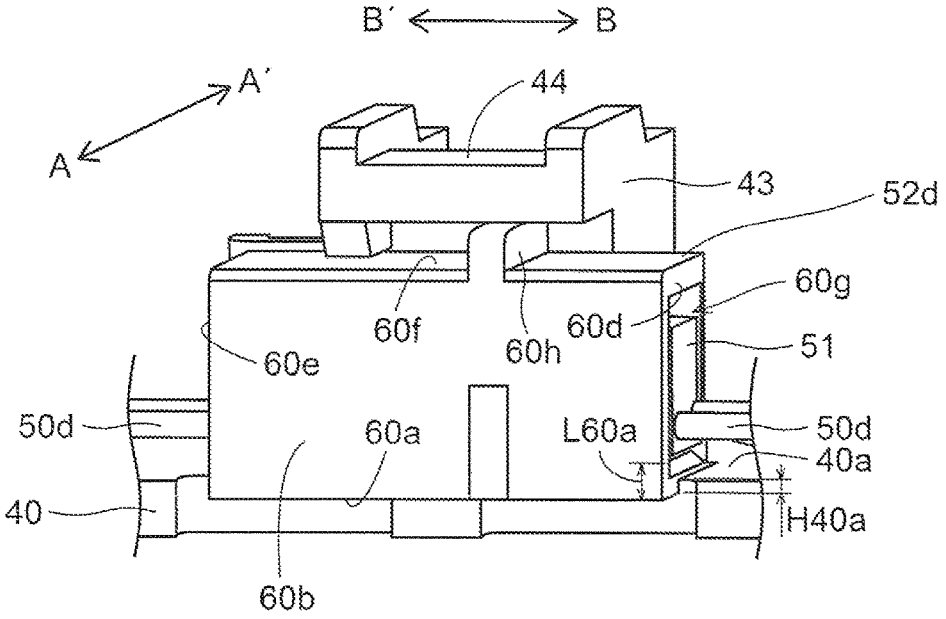
FIG. 11 is a perspective sectional view showing the relay connector fitting structure according to the third embodiment of the present disclosure.
Figure 12:
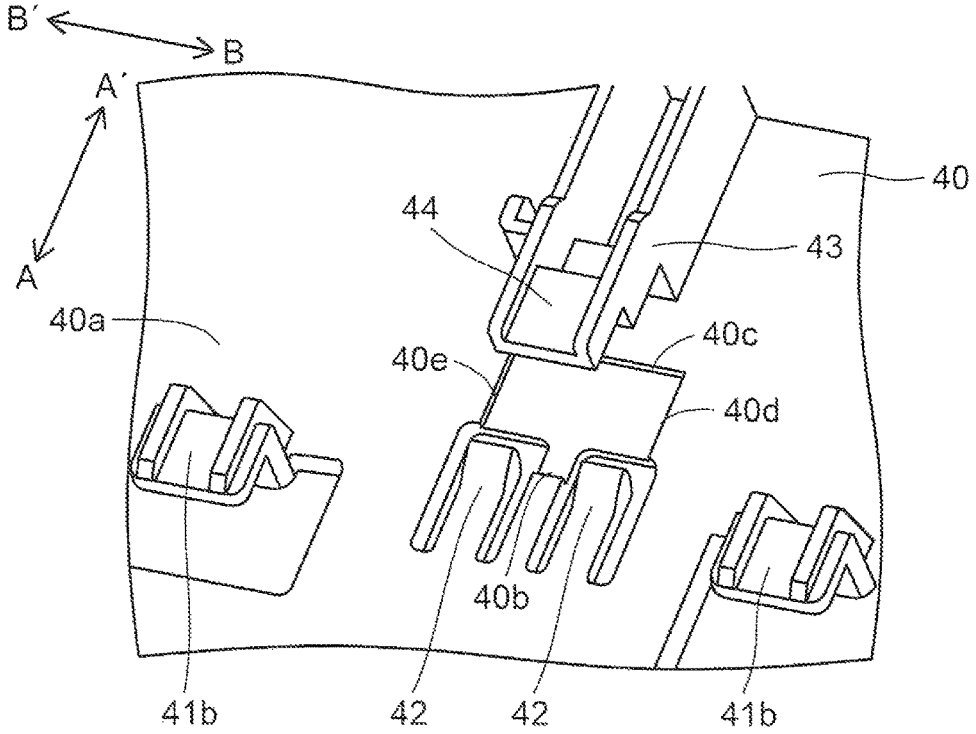
FIG. 12 is a perspective view showing the structure of a chassis to which the relay connector according to the third embodiment of the present disclosure is fitted.

According to a third embodiment of the present disclosure, as shown in FIGS. 10 to 12, a region of the fitting surface 40*a* of the chassis 40 where the relay connector 52*d* is arranged is formed to be recessed in the thickness direction of the chassis 40. Thus, in edge parts of the region of the fitting surface 40*a* where the relay connector 52*d* is arranged, there are formed a first step 40*b* which is arranged to face the first side surface 60*b*, a second step 40*c* (second stopper) which is arranged to face the second side surface 60*c*, a third step 40*d* (third stopper) which is arranged to face the third side surface 60*d*, and a fourth step 40*e* (fourth stopper) which is arranged to face the fourth side surface 60*e*.

The second step 40*c* restricts movement of the relay connector 52*d* in the arrow-A' direction. The third step 40*d* restricts movement of the relay connector 52*d* in the arrow-B direction. The fourth step 40*e* restricts movement of the relay connector 52*d* in the arrow-B' direction.

Moreover, as shown in FIG. 11, the height difference H40*a* between the region of the fitting surface 40*a* where the relay connector 52*d* is arranged and the part surrounding it is smaller than the distance L60*a* (=L60*g*) from the facing surface 60*a* of the relay connector 52*d* to the fitting recesses 60*g*.

In other respects in terms of structure, the third embodiment is similar to the first embodiment described previously.

In this embodiment, as described above, the regions of the fitting surface 40*a* where the relay connectors 52*a* to 52*d* are arranged are formed to be recessed in the thickness direction of the chassis 40, and the third and fourth steps 40*d* and 40*e* are constituted by the steps formed in edge parts of the regions of the fitting surface 40*a* where the relay connectors 52*a* to 52*d* are arranged. Thus, it is possible to easily suppress movement of the relay connectors 52*a* to 52*d* in the arrows-BB' direction.

Moreover, as described above, the height difference H40*a* between the regions of the fitting surface 40*a* where the relay connectors 52*a* to 52*d* are arranged and the parts surrounding them is smaller than the distance L60*a* from the facing surfaces 60*a* of the relay connectors 52*a* to 52*d* to the fitting recesses 60*g*. This helps suppress a lowering in the ease of fitting and removal of the connectors 51 to and from the relay connectors 52*a* to 52*d*.

In other respects in terms of benefits, the third embodiment is similar to the first and second embodiments described previously.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, although the above description deals with examples where the present disclosure is applied to an image forming apparatus, this is not meant to limit the application of the present disclosure. Needless to say, the present disclosure is applicable to a variety of electronic appliances provided with a structure for fitting relay connectors.

Although the above embodiments deal with examples where the cable 53 is taken as a non-connector cable that is not connected to the connectors 51, this is not meant to limit the implementation of the present disclosure. As a matter of fact, around the relay connector 52*c*, the cables 50*d* and 53 are non-connector cables; around the relay connector 52*b*, the cables 50*c*, 50*d*, and 53 are non-connector cables; and around the relay connector 52*a*, the cables 50*b*, 50*c*, 50*d*, and 53 are non-connector cables.

What is claimed is:

1. A relay connector fitting structure, comprising:

an end connector provided at an end part of a cable, the end connector comprising a plurality of end connectors;

a relay connector to which the plurality of end connectors are removably fitted; and a chassis having a fitting surface to which the relay connector is fitted, wherein the relay connector has a facing surface arranged to face the fitting surface, a plurality of side surfaces arranged upright from end edges of the facing surface, and an opposite surface arranged on a side opposite from the facing surface, the chassis has, formed integrally therewith, a first stopper arranged to face a first side surface, which is one of the plurality of side surfaces of the relay connector arranged in a first direction, the first stopper restricting movement of the relay connector in the first direction, a second stopper arranged to face a second side surface, which is one of the plurality of side surfaces of the relay connector arranged in a second direction opposite to the first direction, the second stopper restricting movement of the relay connector in the second direction, and an opposite surface stopper arranged to face the opposite surface of the relay connector, the opposite surface stopper restricting movement of the relay connector to a side opposite from the fitting surface, the opposite surface stopper is formed to be continuous with a tip part of the second stopper, and the second stopper is formed in a shape of steps to leave a gap between the second stopper and the relay connector.

2. The relay connector fitting structure of claim 1, wherein the first stopper protrudes from the fitting surface and is formed, as a result of a part around the first stopper being cut out, to be elastically deformable in a thickness direction of the chassis.

3. An electronic appliance, comprising the relay connector fitting structure of claim 1.

4. An image forming apparatus, comprising:

the relay connector fitting structure of claim 1; and an image forming section for forming an image.

5. A relay connector fitting structure, comprising:

an end connector provided at an end part of a cable, the end connector comprising a plurality of end connectors;

a relay connector to which the plurality of end connectors are removably fitted;

a chassis having a fitting surface to which the relay connector is fitted; and a non-connector cable not connected to the end connector, wherein the relay connector has a facing surface arranged to face the fitting surface, a plurality of side surfaces arranged upright from end edges of the facing surface, and an opposite surface arranged on a side opposite from the facing surface, the chassis has, formed integrally therewith, a first stopper arranged to face a first side surface, which is one of the plurality of side surfaces of the relay connector arranged in a first direction, the first stopper restricting movement of the relay connector in the first direction, a second stopper arranged to face a second side surface, which is one of the plurality of side surfaces of the relay connector arranged in a second direction opposite to the first direction, the second stopper restricting movement of the relay connector in the second direction, and an opposite surface stopper arranged to face the opposite surface of the relay connector, the opposite surface stopper restricting movement of the relay connector to a side opposite from the fitting surface, and the non-connector cable is laid in a gap between the second stopper and the relay connector.

6. The relay connector fitting structure of claim 5, wherein the first stopper protrudes from the fitting surface and is formed, as a result of a part around the first stopper being cut out, to be elastically deformable in a thickness direction of the chassis.

7. The relay connector fitting structure of claim 5, wherein the opposite surface stopper is formed to be continuous with the second stopper.

8. An electronic appliance, comprising the relay connector fitting structure of claim 5.

9. An image forming apparatus, comprising:

the relay connector fitting structure of claim 5; and an image forming section for forming an image.

10. A relay connector fitting structure, comprising:

an end connector provided at an end part of a cable, the end connector comprising a plurality of end connectors;

a relay connector to which the plurality of end connectors are removably fitted; and a chassis having a fitting surface to which the relay connector is fitted, wherein the relay connector has a facing surface arranged to face the fitting surface, a plurality of side surfaces arranged upright from end edges of the facing surface, and an opposite surface arranged on a side opposite from the facing surface, the chassis has, formed integrally therewith, a first stopper arranged to face a first side surface, which is one of the plurality of side surfaces of the relay connector arranged in a first direction, the first stopper restricting movement of the relay connector in the first direction, a second stopper arranged to face a second side surface, which is one of the plurality of side surfaces of the relay connector arranged in a second direction opposite to the first direction, the second stopper restricting movement of the relay connector in the second direction, and an opposite surface stopper arranged to face the opposite surface of the relay connector, the opposite surface stopper restricting movement of the relay connector to a side opposite from the fitting surface, and the chassis further has, formed integrally therewith, a third stopper arranged to face a third side surface, which is one of the plurality of side surfaces of the relay connector arranged in a third direction perpendicular to the first and second directions, the third stopper restricting movement of the relay connector in the third direction, and a fourth stopper arranged to face a fourth side surface, which is one of the plurality of side surfaces of the relay connector arranged in a fourth direction opposite to the third direction, the fourth stopper restricting movement of the relay connector in the fourth direction.

11. The relay connector fitting structure of claim 10, wherein the third and fourth side surfaces of the relay connector respectively have fitting recesses formed therein in which the end connectors are fitted.

12. The relay connector fitting structure of claim 11, wherein the third and fourth stoppers respectively have inclined surfaces formed thereon which guide the end connectors into the fitting recesses.

13. The relay connector fitting structure of claim 11, wherein a protrusion height of the third and fourth stoppers relative to the fitting surface is smaller than a distance from the fitting surface to the fitting recesses.

14. The relay connector fitting structure of claim 10, wherein a region of the fitting surface in which the relay connector is arranged is formed to be recessed in a thickness direction of the chassis, and the third and fourth stoppers are constituted by steps formed in edge parts of the region of the fitting surface in which the relay connector is arranged.

15. The relay connector fitting structure of claim 14, wherein the third and fourth side surfaces of the relay connector respectively have fitting recesses formed therein in which the end connectors are fitted, and a height difference between the region of the fitting surface in which the relay connector is arranged and a part surrounding the region is smaller than a distance from the facing surface of the relay connector to the fitting recesses.

16. The relay connector fitting structure of claim 10, wherein the first stopper protrudes from the fitting surface and is formed, as a result of a part around the first stopper being cut out, to be elastically deformable in a thickness direction of the chassis.

17. The relay connector fitting structure of claim 10, wherein the opposite surface stopper is formed to be continuous with the second stopper.

18. An electronic appliance, comprising the relay connector fitting structure of claim 10.

19. An image forming apparatus, comprising:

the relay connector fitting structure of claim 10; and an image forming section for forming an image.

* * * * *